US007337876B2

(12) United States Patent
Larsen

(10) Patent No.: US 7,337,876 B2
(45) Date of Patent: Mar. 4, 2008

(54) SUCTION APPARATUS WITH NOISE REDUCTION MEANS

(75) Inventor: Peter Nøhr Larsen, Copenhagen NV (DK)

(73) Assignee: Nilfisk-Advance A/S (DK)

( * ) Notice: Subject to any disclaimer, the term of this patent is extended or adjusted under 35 U.S.C. 154(b) by 0 days.

(21) Appl. No.: 10/333,041

(22) PCT Filed: Jul. 3, 2001

(86) PCT No.: PCT/DK01/00465

§ 371 (c)(1),
(2), (4) Date: Aug. 22, 2003

(87) PCT Pub. No.: WO02/05697

PCT Pub. Date: Jan. 24, 2002

(65) Prior Publication Data

US 2004/0026167 A1 Feb. 12, 2004

(30) Foreign Application Priority Data

Jul. 14, 2000 (EP) ..... 00202505

(51) Int. Cl.
*F01N 1/02* (2006.01)
*H02K 5/24* (2006.01)
*F01N 3/02* (2006.01)
*F01N 1/08* (2006.01)

(52) U.S. Cl. ..... 181/225; 181/231; 181/250; 181/266; 181/273; 181/276

(58) Field of Classification Search ..... 181/293, 181/224, 200, 213, 225, 231, 270, 283, 210, 181/202, 249, 253, 255, 250, 266, 273, 276; 60/725; 244/119
See application file for complete search history.

(56) References Cited

U.S. PATENT DOCUMENTS

| | | | | | |
|---|---|---|---|---|---|
| 2,546,707 | A | * | 3/1951 | Wallingford | 181/225 |
| 3,773,141 | A | * | 11/1973 | Thien et al. | 181/293 |
| 4,244,439 | A | * | 1/1981 | Wested | 181/210 |
| 4,327,816 | A | * | 5/1982 | Bennett | 181/224 |
| 4,336,863 | A | * | 6/1982 | Satomi | 181/224 |
| 4,346,781 | A | * | 8/1982 | Ingard et al. | 181/224 |
| 4,418,443 | A | | 12/1983 | Fischer | |
| 4,821,839 | A | * | 4/1989 | D'Antonio et al. | 181/293 |
| 4,944,362 | A | * | 7/1990 | Motsinger et al. | 181/213 |
| 4,970,753 | A | * | 11/1990 | Herron, Jr. | 15/326 |
| 5,129,793 | A | | 7/1992 | Blass et al. | |
| 5,276,291 | A | * | 1/1994 | Norris | 181/224 |
| 5,326,317 | A | * | 7/1994 | Ishizu et al. | 181/202 |
| 5,815,842 | A | * | 10/1998 | Hiselius | 181/129 |

(Continued)

FOREIGN PATENT DOCUMENTS

DE 40 37 442 8/1991

(Continued)

*Primary Examiner*—Edgardo San Martin
(74) *Attorney, Agent, or Firm*—Cantor Colburn LLP

(57) ABSTRACT

A suction apparatus is provided with noise reduction means in one or more airflow passages for reducing noise emission from an airflow generator or the like, wherein at least one airflow passage is provided with at least one indentation with a predetermined depth extending substantially perpendicularly to the general direction of the noise in the passage.

9 Claims, 3 Drawing Sheets

U.S. PATENT DOCUMENTS

| | | | | | |
|---|---|---|---|---|---|
| 5,817,990 | A | * | 10/1998 | Furse | 181/224 |
| 6,116,375 | A | * | 9/2000 | Lorch et al. | 181/224 |
| 6,290,022 | B1 | * | 9/2001 | Wolf et al. | 181/292 |
| 6,450,289 | B1 | * | 9/2002 | Field et al. | 181/224 |

FOREIGN PATENT DOCUMENTS

| | | | |
|---|---|---|---|
| EP | 0 099 466 | | 2/1984 |
| EP | 0 289 987 | | 11/1988 |
| JP | 51 070971 | | 6/1976 |
| JP | 05 199955 | | 8/1993 |
| JP | 06 030860 | | 2/1994 |
| JP | 06 035478 | | 2/1994 |
| WO | WO 96/23294 | * | 8/1996 |
| WO | WO 97 13443 | | 4/1997 |
| WO | WO 99/10608 | * | 3/1999 |
| WO | WO 00/29684 | | 5/2000 |

* cited by examiner

SUCTION APPARATUS WITH NOISE REDUCTION MEANS

FIELD OF INVENTION

The present invention relates to a suction apparatus with noise reduction means in one or more airflow passages for reducing noise emission from an airflow generator or the like.

DESCRIPTION OF RELATED ART

WO-A-97/13443 discloses a suction apparatus of the above-mentioned kind where the airflow generator is enclosed in a housing with an air inlet and an air outlet. The housing and the outlet are provided with sound-absorbing foamed plastic materials. This means that a significant noise reduction and a compact silencer may be obtained by providing the housing volume and at the outlet flow passages with a sound insulation material. Although this solution offers good dampening of the noise emission, this noise reduction solution comprises many different components and is therefore somewhat troublesome to assemble and consequently relatively expensive to manufacture.

Another solution to the noise reduction problem is known from EP-A-0 099 466, in which a vacuum cleaner is disclosed This vacuum cleaner is provided with a sound-absorbing foam material around the motor housing and around the inlet and outlet passages lined with a sound-absorbing material. The outlet passages in this vacuum cleaner are designed with several changes in cross-section areas and with bends in order to provide changes in the acoustical properties that lead to reflections of the noise. The vacuum cleaner is moreover provided with a dampener in front of the air inlet. Although this solution can provide an additional silencing effect, it is relatively extensive in dimensions and complex in design, making it cumbersome and relatively expensive to manufacture.

Another kind of noise reduction solution for a vacuum cleaner is known from DE-A-40 37 442, in which an insert unit is inserted in the air outlet that directs the airflow through a serpentine-like flow-pattern. This noise reduction solution takes up a considerable amount of space and has a somewhat limited noise-reducing effect. Also, as the air is repeatedly diverted in this manner, it may cause an undesired loss in pressure.

Another solution to noise reduction in a vacuum cleaner is known from EP-A-0 289 987, in which the exhaust passage is provided with a silencing passage consisting of a number of concentric air-tight tubular ribs defining a number of concentric exhaust airflow passages. A noise absorption material is provided along the upper walls of the passages. However, this solution is bulky in design and does not provide a satisfactory noise reduction.

Normally, the airflow generator is made up by an electric motor connected to a blower, i.e. a radial ventilator. When the vacuum cleaner is only used for dry suction cleaning, the primary airflow through the blower is also used for cooling the electric motor. However, when the vacuum cleaner is designed for use in a wet environment, the motor must be cooled by a separate cooling ventilator. Both the blower and the cooling ventilator cause emission of noise. The noise extends to the surroundings through the exhaust passage of the primary airflow and from the inlet and the exhaust air passages of the cooling air. The sound-absorbing material may be provided in the airflow passages or around the motor. However, the cooling ventilator is particularly difficult to silence in this manner due to the relatively short airflow passages. Furthermore, noise from the cooling ventilator is of a narrow band nature which makes it suitable for reduction by means of the described technique.

From JP 06 035478 A and JP 06 030860 A some other solutions concerning noise reduction of vacuum cleaners are known where a resonance type acoustic filter is provided. However, although this has a silencing effect their design is somewhat space consuming just as the production of these acoustic filters as an integral part of the vacuum cleaner housing is difficult and expensive.

SUMMARY OF THE INVENTION

The invention provides a suction apparatus with noise reduction means which is simple to manufacture and includes a compact structure so as to allow for a compact design of the device in which the airflow generator is installed.

The suction apparatus is further provided, wherein at least one airflow passage is included having a plurality of indentations arranged successively in the direction of the airflow, said indentations having a predetermined depth extending substantially perpendicularly to the general direction of the noise in the passage, and the indentations are formed by providing protruding wall members on at least one side of the flow passage.

This object is achieved by a suction apparatus of the initially mentioned kind, wherein at least one airflow passage is provided with a plurality of indentations is arranged successively in the direction of the airflow, said indentations having a predetermined depth extending substantially perpendicularly to the general direction of the noise in the passage, and that the indentations are formed by providing protruding wall members on at least one side of the flow passage.

By the invention, a suction apparatus with noise reduction means is provided which is simple and efficient at reducing the noise and also inexpensive to manufacture. The noise is dampened as it extends in an airflow passage. A suction apparatus according to the invention is suitable for use in a vacuum cleaner with a separately cooled airflow generator by providing the airflow passages leading to the airflow generator and/or the ventilator with noise reduction means.

The principle at work by noise reduction according to the invention is that part of the noise that extends in the passage will extend into the indentations. At the bottom of the indentation, the noise will be reflected back into the passage. When the indentations have a depth corresponding to a ¼ of the wave length of the noise, the noise wave reflected by the bottom of the indentation may interfere destructively with the noise in the passage. Hereby, the noise will be reduced at particular frequencies as the reflected noise will cancel out the noise in the passage, resulting in a considerable reduction in the noise level.

the wall members are provided perpendicular to the direction of the airflow. The effect of the noise reduction is optimised when the height or heights of the wall members or indentations is/are $\frac{1}{4}+n\times\frac{1}{2}$ of the wave length of the noise to be reduced, where n is an integer number, including n=0. Hereby, the indentations may be particularly suitable for silencing noise at one or more predetermined frequencies by choosing an appropriate depth of the indentations. However, noise reduction not only occurs at the predetermined frequencies but also at frequencies in close proximity thereto.

A plurality of indentations is arranged successively in the direction of the airflow, whereby an improved effect of the noise reduction is obtained in a simple manner and by a compact structure. Hereby, a noise filter may be integrally moulded in the parts making up the housing of the suction apparatus.

Preferably, the indentations are sub-diverted into sub-indentations in the traverse direction of the general direction of the airflow. The width of the indentations generally corresponds to the length and is shorter than the depth. Hereby, it is ensured that the noise cannot travel "sideways" and fail to interfere with the remaining noise in the passage.

In a preferred embodiment, the indentations are formed by providing protruding wall members on at least one side of the flow passage. Hereby, the noise reduction means may be integrally formed in the housing members defining the airflow passages. When a plurality of indentations is required, a plurality of wall members is provided. In a particular embodiment, a grid of protruding wall members is provided in the airflow passage.

In a first embodiment, the airflow generator is separately cooled and provided with noise reduction means in one or more of the airflow passages. Alternatively, the airflow generator may be cooled by the primary airflow generated.

BRIEF DESCRIPTION OF THE FIGURES

The invention will be described in detail below with reference to the accompanying drawings, in which.

DETAILED DESCRIPTION OF THE INVENTION

Figure 1:
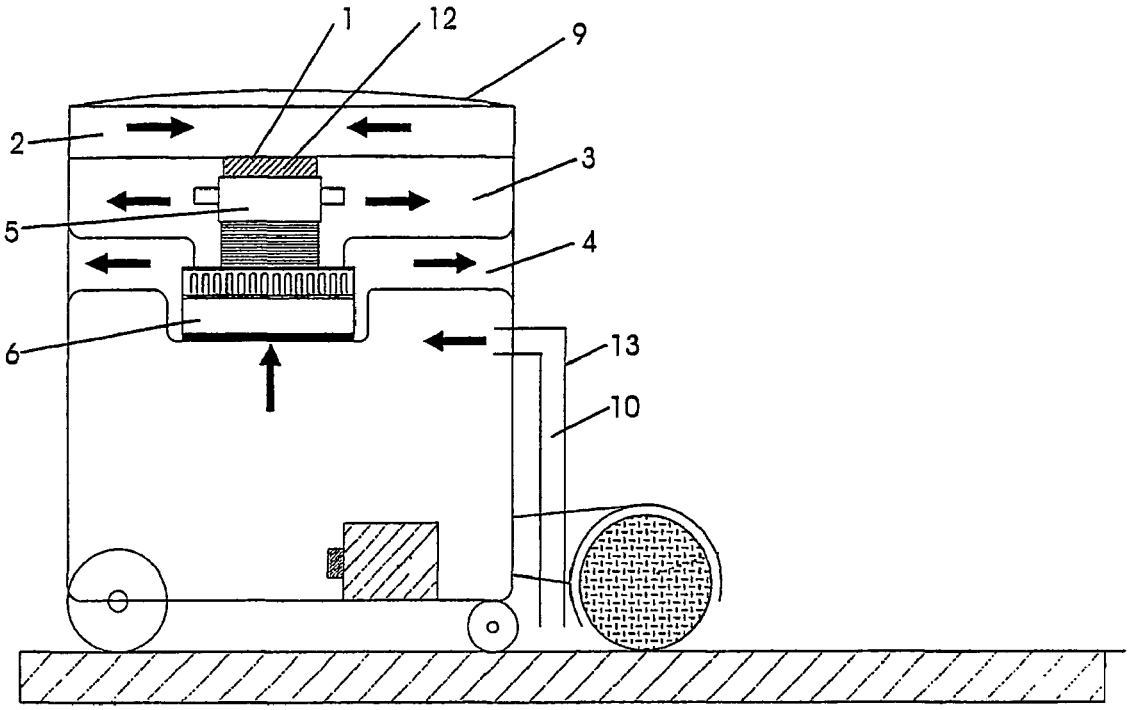
FIG. 1 is a schematic side view of a suction apparatus.

FIG. 1 is a schematic view of a vacuum cleaner with a separately cooled airflow generator 1. The airflow generator 1 comprises an electric motor 5 connected to a blower 6 for generation of the primary suction airflow in the suction hose 10. On top, the electric motor 5 is equipped with a cooling fan 12 for cooling the motor 5.

Airflow passages 2, 3, 4 and 10 are provided in association with the blower 6 and the fan 12. The vacuum generated by the blower causes a primary airflow through the air hose 13. This air is exhausted through the primary air outlet passage 4.

Air for cooling of the electric motor 5 is drawn in through an inlet passage 2 by the fan 12. The utilised cooling air is exhausted through the cooling air outlet passage 3.

The noise generated by the airflow generator and/or by the velocity of the airflow travels through the passages 2, 3, 4, 10 from the noise-emitting source and into the surroundings irrespective of the general flow direction of the air (see arrow indications) in the passages.

Figure 2:
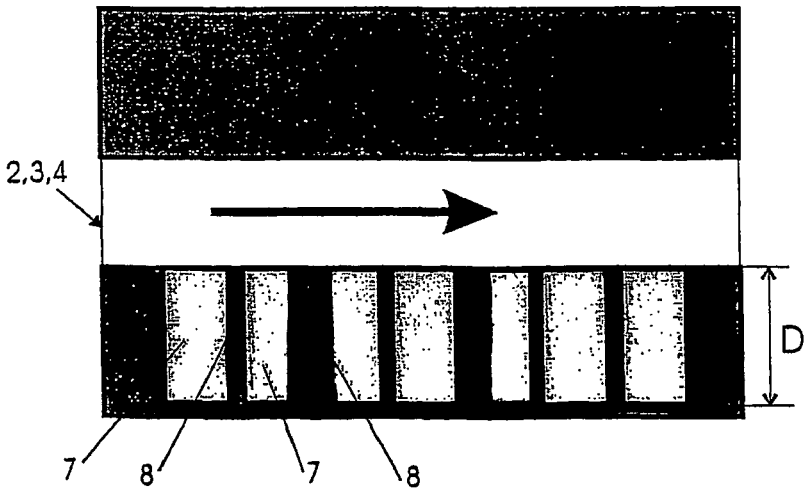
FIG. 2 is a principle illustration explaining the noise reduction principle according to the invention.

In order to reduce this noise emission, one or more of the passages 2, 3, 4 may be provided with noise reduction means 7, 8. A noise reduction means according to the invention comprises a repeated structure such as shown in FIG. 2. According to the invention, the noise reduction means involves a number of indentations 7 extending from one of the passage walls substantially perpendicularly to the direction of the noise in the particular passage 2, 3, 4. The indentations 7 are successively arranged in the direction of the airflow and are separated by wall members 8. In one embodiment of the present invention, the thicknesses of the wall members 8 vary as shown in FIG. 2. The indentations 7 are provided with a predetermined depth D that generally corresponds to the frequency of the noise in the passage to be silenced.

The depths of the indentations 7 may not necessarily be the same but may vary in order to reduce noise over a broader range of frequencies. This, however, is achieved at the expense of a less efficient noise reduction.

Part of the noise-travelling through the passage 2, 3, 4 will extend into the indentations 7. At the bottom of the indentations 7, the noise is reflected back into the passage 2, 3, 4. The reflected noise is delayed and is thus out of phase with the noise in the passage. This results in a destructive interference of the reflected noise and noise in the passage, generating a significant noise reduction. The noise-reducing effect is optimised when the noise has a frequency that corresponds to a indentation depth D of ¼, ¾, ⅝, etc. of the wave length. Moreover, the effect is also improved if the indentations extend across the entire width of the passage and/or if several indentations are provided successively.

In a vacuum cleaner, the noise from the airflow generator is at its most intense level within the frequency range 1 kHz to 5 kHz. The cooling ventilator in a separately cooled motor scatters noise at a somewhat higher frequency within in the range of 2 kHz to 7 kHz.

In table 1, the preferred depths D of the indentations 7 are indicated for dampening noise within a relevant frequency range:

TABLE 1

Indentation depths and their corresponding frequencies of maximum dampening corresponding to ¼, ¾ or ⅝ of the wave length.

| Depth D | Dampening at | Dampening at | Dampening at |
|---|---|---|---|
| 86 mm | 1 kHz | 3 kHz | 5 kHz |
| 43 mm | 2 kHz | 6 kHz | — |
| 17 mm | 5 kHz | — | — |
| 12 mm | 7 kHz | — | — |

As it appears from table 1, the indentation depth D—or height of the wall members 8—should preferably be between 17 mm and 86 mm. Increased depth is particularly advantageous, as it provides a dampening effect at more frequencies within the relevant frequency range.

A noise reduction means according to the invention is advantageous as the noise reduction may be integrated in passage defining parts of the vacuum cleaner and produced in a mouldable plastic material by an injection moulding process. This means that no extra sound-absorbing elements need to be placed in the vacuum cleaner.

Figure 3:
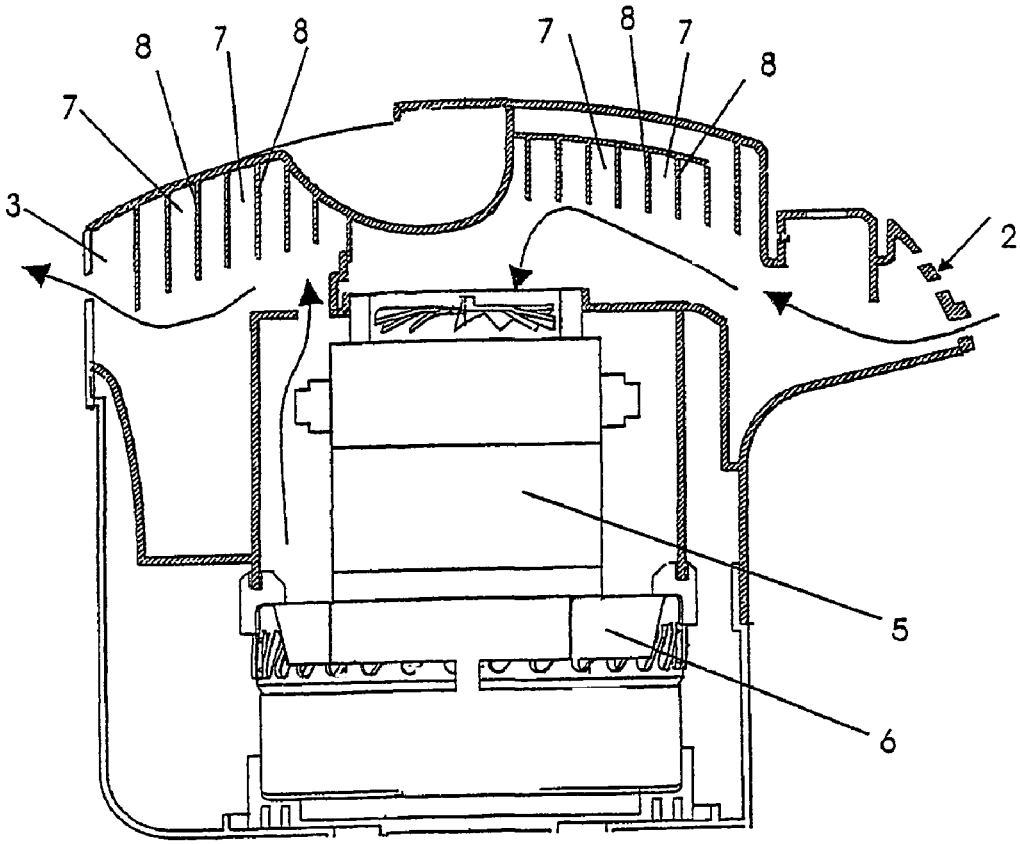
FIG. 3 is a cross-section view of a suction apparatus according to a first embodiment of the invention.

A first embodiment of the invention is shown in FIG. 3, where a number of thin wall members 8 extend downwards from the top passage wall and into the airflow passages 2, 3. Hereby, a number of indentations 7 are formed between the thin wall members 8. The length of the thin wall members 8 (i.e. the depth D of the indentations 7) may vary, such as indicated in the figure, in order to adapt the noise reduction means to different frequencies.

Figure 4:
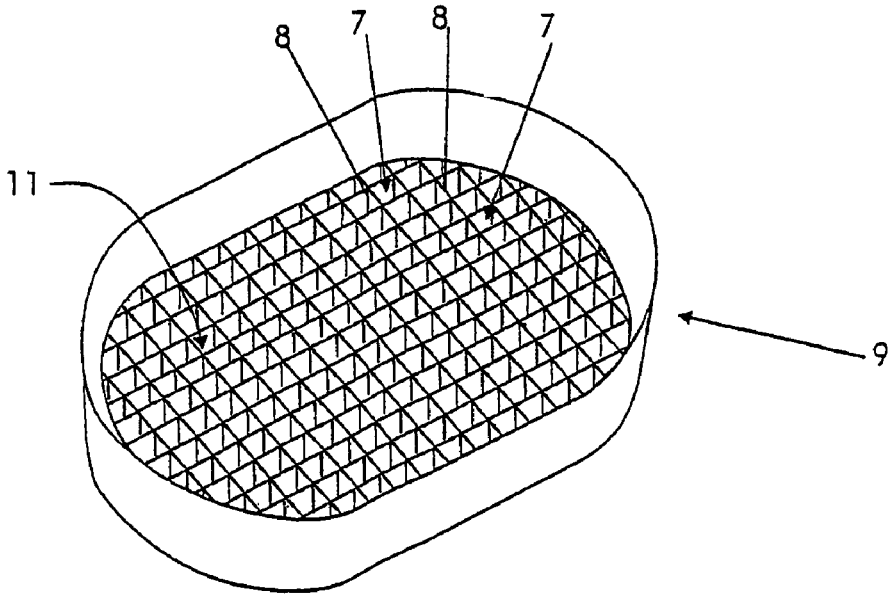
FIG. 4 is a perspective view of a lid part of a suction apparatus with a noise reduction means according to a second embodiment of the invention.

In a second preferred embodiment, the top lid 9 of a vacuum cleaner is provided with a grid 11 of thin wall members 8 forming a number of cells acting as noise-reducing indentations 7, see FIG. 4. The grid 11 may be integrally formed on the inside of the lid part 9. By using a grid, the indentations 7 are sub-divided so that noise is prevented from travelling "sideways" down into the grooves or indentations. The grid 11 is advantageous as it may be provided across the entire width of a passage wall, causing a significant noise reduction.

Figure 5:
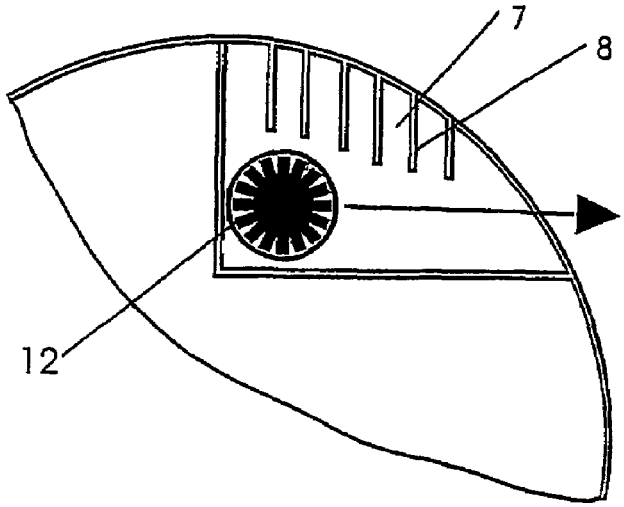
FIG. 5 is a detailed schematic view incorporating a third embodiment of the noise reduction principle according to the invention.
Figure 6:
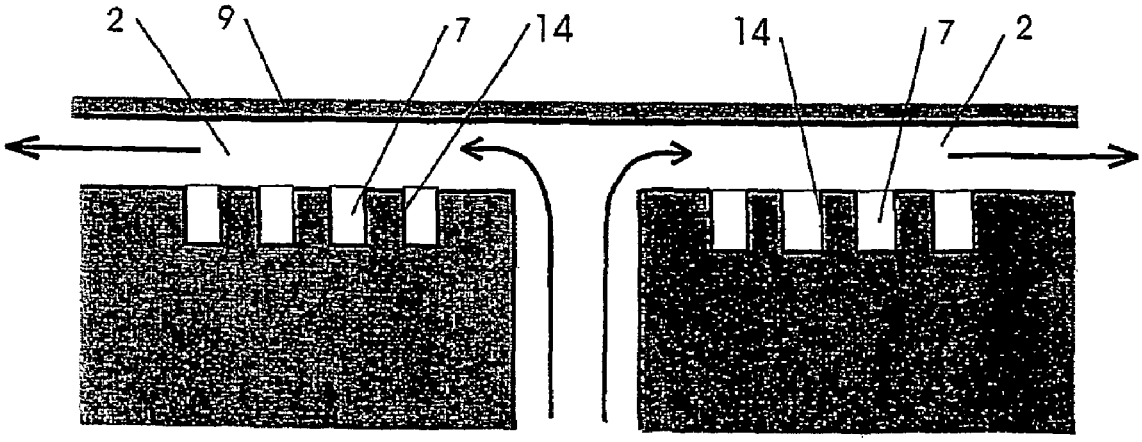
FIG. 6 is a detailed schematic view incorporating a fourth embodiment of the invention.

Other embodiments of the invention are shown in FIGS. 5 and 6. In FIG. 5, the noise reduction may be performed in a relative short air exhaust passage 4. In FIG. 6, the lower passage wall is provided with noise indentations separated by thin wall elements 14.

As it can be appreciated from the various embodiments, the principle of noise reduction according to the invention has a wide range of use and may be used to dampen noise in a vacuum cleaner which travels through a passage irrespective of its origin.

The invention claimed is:

1. A suction apparatus, comprising:

noise reduction means in one or more airflow passages for reducing noise emission from an airflow generator; and a plurality of indentations arranged in at least one of the airflow passages successively in the direction of the airflow, said indentations having a predetermined depth extending substantially perpendicularly to a general direction of the noise in the passage, the indentations being formed by protruding wall members disposed on at least one side of the flow passage, which wall members are formed integrally in bowing members of the suction apparatus defining the airflow passage, wherein heights of each of the wall members are ¼ $(2n+1)\lambda$, where $\lambda$ is a wave length of the noise to be reduced and n is an integer number, including n=0.

2. A suction apparatus according to claim 1, wherein the height of all the wall members in the at least one airflow passage is the same.

3. A suction apparatus according to claim 1, wherein heights of the wall members in the at least one air flow passage are different in order to reduce noise at different frequencies.

4. A suction apparatus according to claim 1, wherein the indentations are sub-diverted into sub-indentations in a direction traverse to the direction of the noise.

5. A suction apparatus according to claim 1, wherein the wall members comprise a plurality of wall members of different thicknesses.

6. A suction apparatus according to claim 1, wherein the wall members are disposed perpendicular to the direction of the airflow.

7. A suction apparatus according to claim 1, wherein the wall members comprise a grid of protruding wall members provided in the airflow passage.

8. A suction apparatus according to claim 1, wherein the airflow generator is separately cooled.

9. A suction apparatus according to claim 1, wherein wall members are molded integrally in housing members.

* * * * *